United States Patent [19]

Cunningham et al.

[11] Patent Number: 4,687,905

[45] Date of Patent: Aug. 18, 1987

[54] ELECTRIC IMMERSION HEATING ELEMENT ASSEMBLY FOR USE WITH A PLASTIC WATER HEATER TANK

[75] Inventors: Donald M. Cunningham, Pittsburgh, Pa.; Mark A. Bartels, Columbus, Miss.; T. Randall Markum, Vernon, Ala.

[73] Assignee: Emerson Electric Co., St. Louis, Mo.

[21] Appl. No.: 825,463

[22] Filed: Feb. 3, 1986

[51] Int. Cl.[4] ..... H05B 3/82; H05B 1/02; F24H 1/20

[52] U.S. Cl. ..... 219/336; 219/316, 318; 219/331; 219/517; 219/523

[58] Field of Search ..... 219/306, 310, 312, 316, 219/318, 331, 328, 523, 335, 336, 437, 517

[56] References Cited

U.S. PATENT DOCUMENTS

| | | | |
|---|---|---|---|
| 1,715,687 | 6/1929 | Vaughan | 219/331 X |
| 2,286,470 | 6/1942 | Dafforn et al. | 219/437 |
| 2,524,954 | 10/1950 | Best | 219/318 X |
| 2,763,763 | 9/1956 | Cunningham et al. | 219/336 |
| 3,319,049 | 5/1967 | Ulanet | 219/335 X |
| 3,450,860 | 6/1969 | Kneisley | 219/331 |
| 3,673,385 | 6/1972 | Drugmamd et al. | 219/316 X |
| 4,263,499 | 4/1981 | Romance | 219/331 |

FOREIGN PATENT DOCUMENTS

| | | | |
|---|---|---|---|
| 2263469 | 11/1975 | France | 219/306 |
| 562997 | 7/1944 | United Kingdom | 219/437 |
| 2133258 | 7/1984 | United Kingdom | 219/306 |

*Primary Examiner*—Anthony Bartis

*Attorney, Agent, or Firm*—Polster, Polster and Lucchesi

[57] ABSTRACT

A water heater with a plastic tank is provided with an electric immersion heating element assembly having a mounting plug in which is mounted a sheathed heating element having two generally parallel legs and a bight portion. A well projects from the mounting plug along and substantially parallel to the legs in heat exchange relation therewith and contains a thermal cutoff adapted to be electrically connected in series with the first end of a two-ended electric resistance element in the sheathed heating element. A thermally conductive bridge mechanically and thermally connects the legs of the sheathed heating element to the well. The legs of the sheathed heating element are bent back upon themselves and a bracket, connected to the two reaches of at least one leg, permits relative axial movement but prevents lateral movement of the reaches of the legs with respect to one another. The mounting plug is made of solid copper or copper alloy, as is the sheath and well. A molded non-metallic, electrically insulative closure has holes through which a terminal pin from the thermal cutoff and a terminial pin from the second end of the resistance element extend. The molded closure has a boss with a blind hole into which a terminal pin connected to the first end of the heating element extends and to which terminal pin the other terminal pin of the thermal cutoff is connected.

2 Claims, 13 Drawing Figures

ELECTRIC IMMERSION HEATING ELEMENT ASSEMBLY FOR USE WITH A PLASTIC WATER HEATER TANK

BACKGROUND OF THE INVENTION

Heating element assemblies for use in water heaters and the like are illustrated in U.S. Pat. Nos. 4,152,578, 3,943,328, and 3,217,138, which are conventional insofar as they illustrate sheathed heating elements mounted in a mounting plug of either the screw type or surface mounted type. It has been proposed in U.S. Pat. No. 3,943,328, to use a sheath of thermal-plastic material to enclose an electric resistance heater element. The patent states, "of course, if a water tank should run dry, the plastic sheathed heater would not be subjected to the modifying effects of the water and therefore the thermal plastic material would melt and the heater would not be subjected to the modifying effects of the water and therefore the thermal plastic material would melt and the heater would fail, but metal sheathed heaters under these circumstances would also fail. The failure of a heating element or its being energized when not submerged in conventional steel or glass lined tanks will not affect the tank itself, ordinarily. However, with the advent of plastic hot water tanks, conventional electric water heater elements are liable to damage the tank permanently if the heating element were energized in a dry tank.

One of the objects of this invention is to provide a water heater element assembly that can be used safely in a plastic hot water tank.

Another object is to provide such a water heater element assembly that can be manufactured easily, is rugged, dependable, and long-lasting.

Other objects will become apparent to those skilled in the art in the light of the following description and accompanying drawing.

SUMMARY OF THE INVENTION

In accordance with this invention, generally stated, in a water heater with a plastic tank, an electric heating assembly is provided that includes a sheathed heating element with a two-ended electric resistance element within a sheath having two legs, generally parallel, and a bight portion, the free ends of the legs being mounted in a metal plug. A well, mounted at one end in the plug, projects along and substantially parallel to the legs of the heating element, in heat exchange relation therewith. A thermal cutoff is mounted in a well, against an inner wall of the well. The thermal cutoff is electrically connected in series with the electric resistance element. A thermal bridge is mechanically and thermally connected to the well and to the legs. In the preferred embodiment, the electric resistance element has terminal pins electrically and mechanically connected to each of the resistance element ends and projecting beyond an outer face of the mounting plug. The thermal cutoff has two terminals each electrically connected to a thermal cutoff terminal pin projecting from the well and beyond the outer face of the plug. One of the thermal cutoff terminal pins is electrically and mechanically connected to one of the resistance element terminal pins at a place between the outer end of the resistance element terminal pin and the outer face of the plug, leaving a stub portion of the connected resistance element pin projecting beyond the place of connection. A cup-shaped molded closure, with a bottom web has two openings through it, through one of which the unconnected thermal cutoff pin extends and through the other of which the unconnected resistance element extends. The closure has a boss with a blind hole into which the stub portion of the connected resistance element terminal pin projects.

In the preferred embodiment, the legs of the sheathed resistance element are bent back upon themselves intermediate their ends, so as to provide a return reach extending along an inwardly extending reach, with the bight of the element at the end of the return reach toward the plug, and an H-shaped bracket mechanically connects the inwardly extending and the return reaches in such a way as to permit relative axial movement of the inwardly extending and return reaches, but to prevent relative lateral movement thereof.

Preferably the sheath of the heating element and the mounting plug are made of copper or an alloy of copper.

DESCRIPTION OF THE PREFERRED EMBODIMENT

Figure 1:
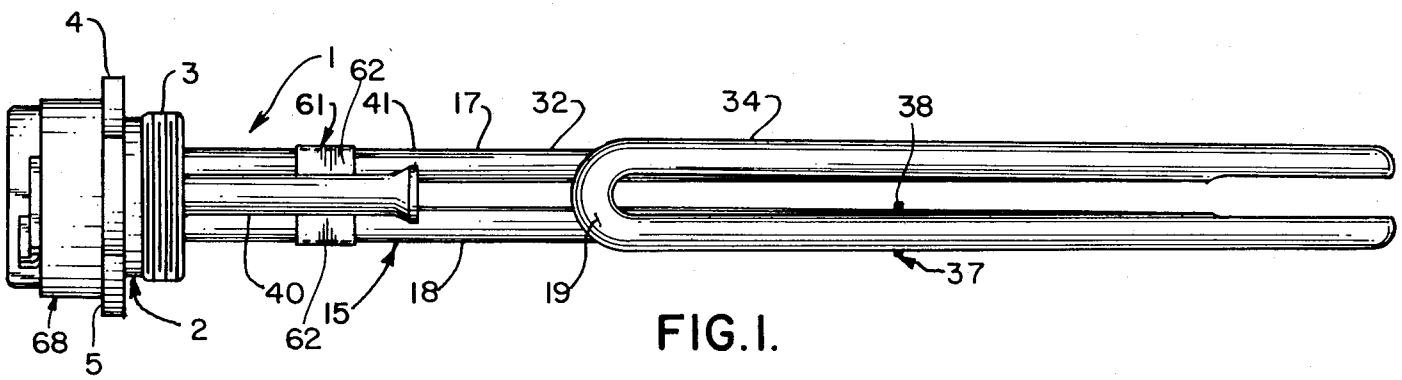
FIG. 1 is a top plan view of one embodiment of heating element assembly of this invention.

Referring now to the drawings for one illustrative embodiment of water heater heating element assembly, reference numeral 1 indicates a completed assembly. In this embodiment, the assembly is provided with a screw plug 2, with a threaded section 3, and a hex flange 4 with a flat outer surface 5.

Figure 4:
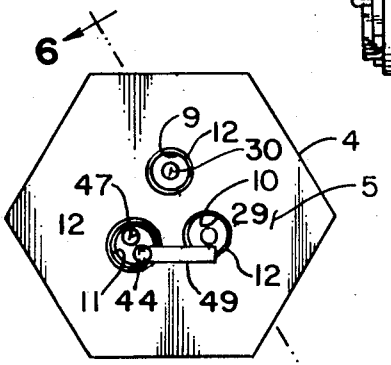
FIG. 4 is a view in end elevation in the same direction as FIG. 3, but with the closure member removed.

The plug 2 has three holes through it, a resistance element terminal hole 9, a resistance element terminal hole 10, and a thermal cutoff terminal hole 11. Channels 12 in the outer and inner surfaces of the plug, are concentric with the holes 9, 10 and 11, as shown in FIG. 4.

An electric heating element 15 is carried by the mounting plug 2. The heating element includes a sheath, with two generally parallel legs 17 and 18 and a bight 19 integral with and connecting the two legs. Outer ends 20 of the legs 17 and 18 extend through the holes 9 and 10 and are secured in the plug by staking over the plug material on the radially inboard side of the channels 12, which are formed by the staking operation, into outer grooves 23 and inner grooves 24 in the ends 20, which are also formed by the staking operation as shown particularly in FIG. 6. The outer grooves 23 also serve to hold bushings 25 in the ends 20. The bushings 25 close the open ends of the sheaths to contain the usual densely packed granular refractory material 27 that surrounds the coiled wire resistance element, not here shown, that is conventional in such heating units, as illustrated in the patents to which reference has been made.

Figure 5:
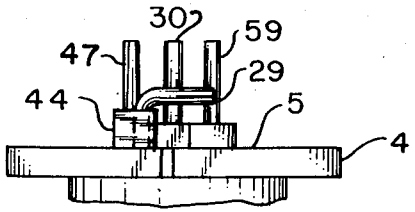
FIG. 5 is a fragmentary view in side elevation of FIG. 4.
Figure 6:
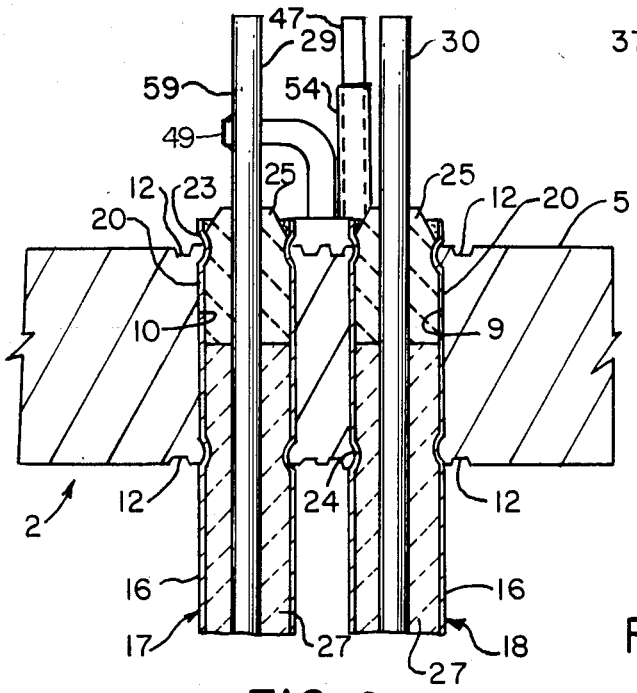
FIG. 6 is an enlarged fragmentary sectional view taken along the line 6—6 of FIG. 4.
Figure 7:
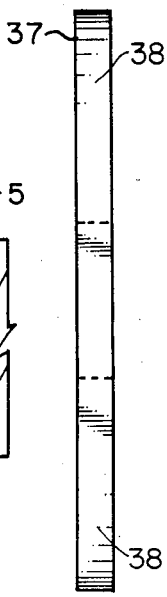
FIG. 7 is a much enlarged view in side elevation of a bracket connecting inwardly and return reaches of the sheathed heating element as shown in FIG. 2.
Figure 8:
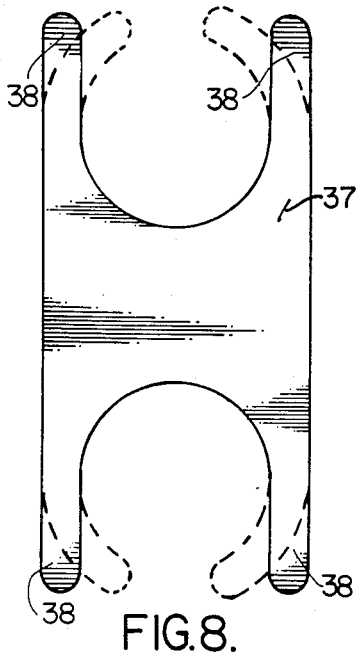
FIG. 8 is a view in front elevation of the bracket shown in FIG. 7, with the bracket in its mounted position shown in dotted lines.
Figure 9:
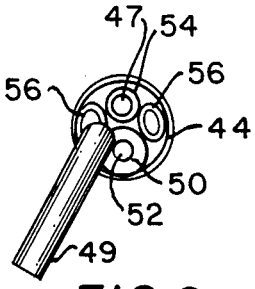
FIG. 9 is an enlarged view in end elevation, as viewed from left to right in FIG. 10.
Figure 13:
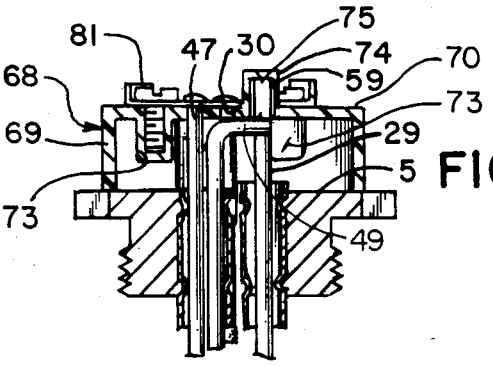
FIG. 13 is a fragmentary sectional view taken along the line 13—13 of FIG. 3.

That resistance element is connected electrically and mechanically at its two ends to resistance element terminal pins 29 and 30, which extend from beyond the inner surface of the plug, through the bushings 25, beyond the ends 20 of the sheaths, and beyond the flat outer surface 5 of the plug 2 as shown in FIGS. 5, 6 and 13.

Figure 2:
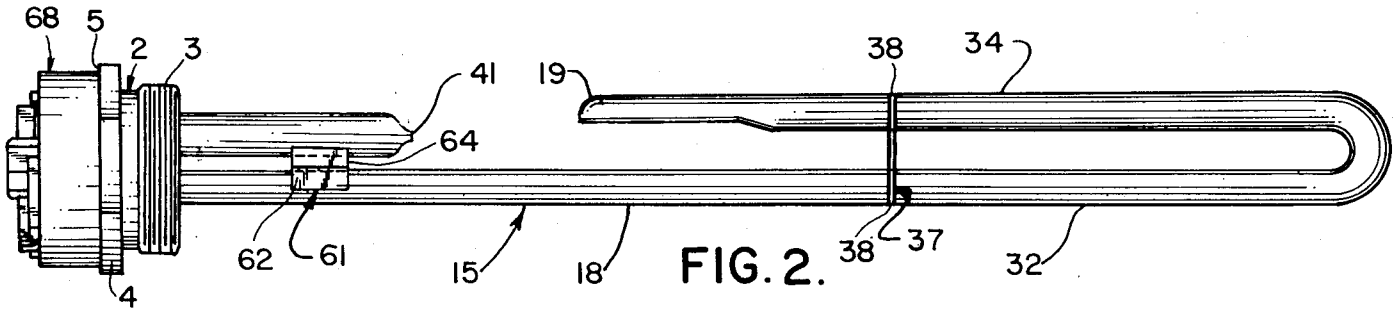
FIG. 2 is a view in side elevation of the device shown in FIG. 1.

In the illustrative embodiment shown, the legs 17 and 18 of the heating element 15 are bent back upon themselves, as shown particularly in FIGS. 1 and 2, so that the bight 19 is relatively close to the plug 2 as compared with the inner end of the heating element. This produces an inward reach 32 and a return reach 34 of the heating element. This permits the use of a longer heating element, hence greater capacity, in a water tank of given diameter. However, it also presents a potential problem of not being able to withdraw the element if the return reach 34 moves laterally away from the inward reach 32. To prevent this, the element of this embodiment is provided with an H-shaped bracket 37, with four legs 38, the outer ends of which are crimped about one of the legs, in the embodiment shown, the leg 18, in both its inward reach 32 and return reach 34, as shown in FIGS. 1, 2 and, in dotted lines, 8.

Figure 10:
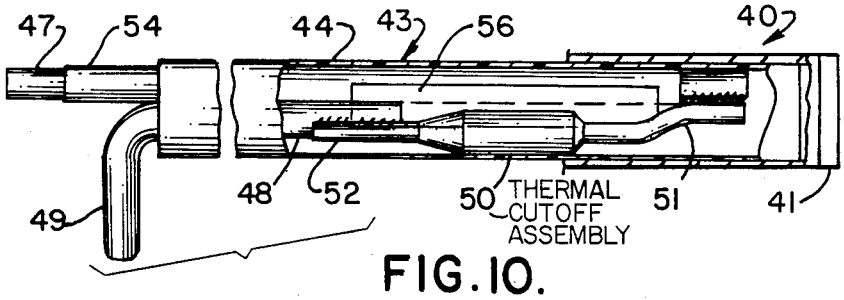
FIG. 10 is a view in side elevation, partly broken away, of a well and thermal cutoff detail of this invention.
Figure 11:
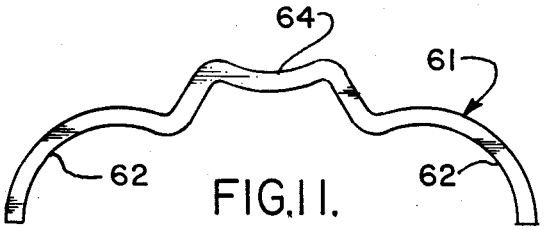
FIG. 11 is an enlarged view in end elevation of a thermal brige.
Figure 12:
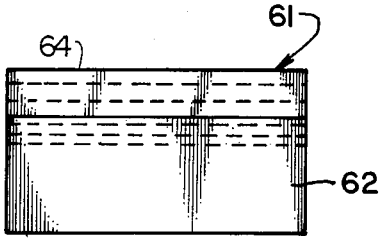
FIG. 12 is a view in side elevation of the bridge shown in FIG. 11.

A well 40 is, in this embodiment, made of copper tubing of a diameter somewhat larger than the copper tubing of which the sheath 16 of the heating element is made. The well has a sealed inner end 41 and an open mouth end. The open mouth end is mounted in the thermal cutoff terminal hole 11 of the plug 2 by the same kind of staking or coining process by which the ends 20 of the heating element 15 are mounted, as shown in FIGS. 6 and 13. Alternatively, it can be soldered in the hole. A thermal cutoff assembly 43 is mounted in the well 40, as shown particularly in FIG. 10. The thermal cutoff assembly 43 includes an outer sleeve 44 of electrically insulative but thermally conductive material such as Nomex or Kapton, a first terminal pin 47, a second terminal pin 48, an outer end 49 of which is bent at right angles to the pin 47, and a thermal cutoff 50, all embraced by the outer sleeve 44. The thermal cutoff has electrical conductors 51 and 52 extending from opposite ends of it. The pin 47 has an insulating sheath 54 intermediate its ends, omitted, for simplicity in illustration, from FIG. 13, but shown in FIG. 10. A bare inner end of the pin 47 is electrically and mechanically connected, as by welding, to the conductor 51. An inner end of the pin 48 is welded or otherwise electrically and mechanically secured to the conductor 52. Spacers 56 of insulating sleeving are used to keep the elements in position, and to insure that the thermal cutoff 50 is in intimate contact with the sleeve 44 and the sleeve in intimate contact with the inside wall of the well 40.

The thermal cutoff assembly is mounted in the well 40, as has been indicated, with the outer sleeve 44 projecting beyond the flat face 5 of the plug, as shown in FIG. 5. The outer sleeve 44 is also omitted from FIG. 13 for clarity. The first pin 47 projects beyond the flat face 5 the same distance as the pins 29 and 30 of the electric resistance element. The bent end 49 of the terminal pin 48 is welded to the terminal pin 29, as shown in FIGS. 5, 6 and 13, at a place between its outer end and the end 20 of the sheath, so as to leave a stub end 59 free of obstruction.

As can be seen clearly in FIGS. 1 and 2, the well 40 is spaced from and parallel to the legs 17 and 18 along their inward reach. In order to ensure good thermal conduction between the legs 17 and 18 and the well 40, hence the thermal cutoff 50, a thermal bridge 61 is provided. The thermal bridge 61, made of copper or a copper alloy, has arms 62 designed at least partly to embrace the legs 17 and 18, and a central saddle 64, contoured to receive the well 40 and provide a substantial area of contact. The arms 62 are soldered or otherwise intimately secured to the legs 17 and 18, and the saddle 64 is similarly secured to the well 40.

A molded, cup-shaped plastic closure 68, with a side wall 69 and a bottom web 70, has holes through it to receive the thermal cutoff terminal pin 47 and the resistance element terminal pin 30, as shown particularly in FIG. 13. As shown in the same figure, the web has, integral with its outer surface, a boss 74, with a blind hole 75 in it opening through the inner surface of the web that receives the stub end 59 of the terminal pin 29. Sockets 73 in the web 70 receive terminal screws 81.

Figure 3:
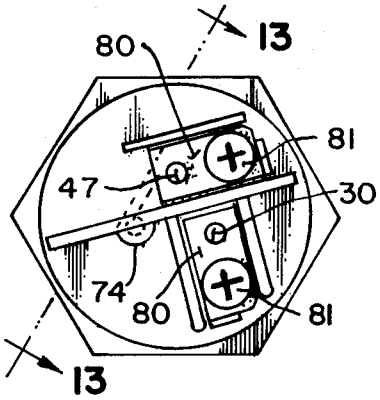
FIG. 3 is a view in end elevation looking from left to right in FIG. 2.

As shown particularly in FIGS. 3 and 13, the outer ends of the pins 47 and 30 extend through holes in terminal plates 80, and are welded or otherwise secured to the plates electrically and mechanically. Terminal screws 81, extending through other holes in the plate and into the sockets 73, serve to mount electrical conductors from a source of power, not here shown. Locating and separating ribs on the outer surface of the closure 68 serve the usual functions, and are omitted in FIG. 13 for clarity.

It can be seen that the construction of the preferred embodiment permits the use of sheathed heating elements of conventional configuration as far as the terminal pins are concerned, and a plug of standard size and shape, but with three holes through it instead of two.

Numerous variations in the construction of the heating element assembly of this invention, within the scope of the appended claims, will occur to those skilled in the art in the light of the foregoing disclosure. For example, a surface mounted plug can be used. The connected terminal pin can be cut off to remove the stub 59. The sheath ends can be soldered or brazed into the plug. The thermal cutoff device is preferably a MICROTEMP (Micro Devices) thermal switch rated at 240 volts, 25 amps continuous and an opening temperature of 360° F., but other forms can be used. These are merely illustrative.

We claim:

1. In a water heater with a plastic tank, a metallic sheathed electric heating element with a two-ended electric resistance element within a sheath having two generally parallel legs and a bight portion integral with and joining the inner end of said two legs, said legs being mounted in a metal plug secured in an opening in the tank wall and projecting into the interior of said plastic tank, the improvement comprising a well mounted at one end in said plug and projecting along and substantially parallel to said legs in said tank in heat exchange relation therewith, and thermal cutoff means in said well electrically connected in series with said electric resistance element, each of said electric resistance element ends having a terminal pin electrically and mechanically connected to it and projecting beyond an outer face of said plug, said thermal cut-off means having two terminals, each electrically connected to a thermal cut-off terminal pin projecting from said well and beyond said outer face of said plug, one of said thermal cut-off terminal pins being electrically and mechanically connected to one of said resistance element terminal pins at a place between the outer end of said resistance element terminal pin and said outer face of said plug, leaving a stub portion of said resistance element pin projecting beyond said place, and a cup-shaped molded non-metallic electrically insulative closure with a bottom web having two openings through it, through one of which the unconnected thermal cut-off terminal pin extends and through the other of which the unconnected resistance element terminal pin extends, said closure web having a boss with a blind hole in it into which the stub portion of said connected resistance element terminal pin projects.

2. In a water heater with a plastic tank, a metallic sheathed electric heating element with a two-ended electric resistance element within a metallic sheath having two generally parallel legs and a bight portion integral with and joining the inner end of said two legs, said legs being mounted in a metal plug secured in an opening in the tank wall and projecting into the interior of said plastic tank, the improvement comprising said plug being a screw plug, a well mounted at one end in said plug and projecting along and substantially parallel to said legs in said tank in heat exchange relation therewith, a thermal cutoff means in said well electrically connected in series with said electric resistance element, a thermal bridge mechanically and thermally interconnecting said well and said legs, each of said electric resistance element ends having a terminal pin electrically and mechanically connected to it and projecting beyond an outer face of said plug, said thermal cutoff means having two terminals, each electrically connected to a thermal cutoff terminal pin projecting from said well and beyond said outer face of said plug, one of said thermal cutoff terminal pins being electrically and mechanically connected to one of said resistance element terminal pins at a place between the outer end of said resistance element terminal pin and said outer face of said plug, leaving a stub portion of said resistance element terminal pin projecting beyond said place, and a cup-shaped molded non-metallic, electrically insulative closure with a bottom web having two openings through it, through one of which the unconnected thermal cutoff terminal pin extends and through the other of which the unconnected resistance element terminal pin extends, said closure bottom web having a boss with a blind hole in it into which the stub portion of said connected resistance element terminal pin projects, the legs of said sheath element being bent back upon themselves intermediate their ends so as to provide a return reach extending along an inwardly extending reach with the said bight at the end of the return reach toward the said plug, and bracket means mechanically connecting said inwardly extending and return reaches, for permitting relative axial movement of said inwardly extending and return reaches but preventing relative lateral movement thereof, said bracket being H-shaped in front elevation and the outer ends of the legs of said bracket being bent toward one another to clasp said legs.

* * * * *